United States Patent [19]

Monigold et al.

[11] Patent Number: 4,483,287

[45] Date of Patent: Nov. 20, 1984

[54] MECHANICAL ENGINE PROTECTION SYSTEM

[75] Inventors: Larry E. Monigold; Ordale Lewis, both of Cadillac, Mich.

[73] Assignee: Kysor Industrial Corporation, Cadillac, Mich.

[21] Appl. No.: 376,688

[22] Filed: May 10, 1982

[51] Int. Cl.[3] ..... F02B 77/08

[52] U.S. Cl. ..... 123/198 DB; 123/41.15; 123/196 S

[58] Field of Search ..... 123/41.15, 196 S, 198 D, 123/198 DB

[56] References Cited

U.S. PATENT DOCUMENTS

| | | | |
|---|---|---|---|
| Re. 26,840 | 3/1970 | Harvey | 236/86 |
| 2,248,094 | 7/1941 | Kysor | 236/35 |
| 2,512,548 | 6/1950 | Kysor | 236/99 |
| 2,581,582 | 1/1952 | Ferris | 236/99 |
| 2,805,027 | 9/1957 | Ferris | 236/35.2 |
| 3,006,552 | 10/1961 | Ferris | 236/35.3 |
| 3,135,495 | 6/1964 | Ferris | 251/366 |
| 3,153,403 | 10/1964 | Dobbs | 123/198 DB |
| 3,202,143 | 8/1965 | Goodwin | 123/41.15 |
| 3,202,161 | 8/1965 | Richards | 123/41.15 |
| 3,492,983 | 2/1970 | Vipperman | 123/198 DB |
| 3,590,798 | 7/1971 | Goodwin | 123/41.15 |
| 3,602,207 | 8/1971 | Kilmer | 123/196 S |
| 3,613,041 | 10/1971 | Graber | 337/315 |
| 3,853,269 | 12/1974 | Graber | 236/86 |
| 3,877,455 | 4/1975 | Goodwin | 123/198 DB |
| 4,065,052 | 12/1977 | Ridenour | 236/86 |
| 4,102,316 | 7/1978 | Valbert | 123/41.15 |
| 4,189,095 | 2/1980 | Monigold et al. | 236/92 R |
| 4,204,513 | 5/1980 | Bilbrey et al. | 123/41.15 |
| 4,205,784 | 6/1980 | Monigold | 236/35.2 |
| 4,239,153 | 12/1980 | Monigold et al. | 236/86 |
| 4,399,785 | 8/1983 | Mills | 123/196 S |

OTHER PUBLICATIONS

Publication entitled, "Kysor Shutters and Controls—Parts and Service Catalog".
Publication entitled, "Kysor Tem-Pressure Protective Equipment for Engines".
Article entitled, "The Kysor 'Tem-Pressure' Engine Alarm and Shutdown System".
Publication entitled, "Chalwyn Thermo-Stop".
Article entitled, "Jet Stop".
Publication entitled, "Sentinel Engine Protection System".
Article entitled, "Intralube Lostop".
Article entitled, "Hydro-Mechanical Safety Shutdown System".
Publication entitled, "Diesel Equipment Superintendent", Apr., 1977, p. 108.

*Primary Examiner*—Ira S. Lazarus
*Attorney, Agent, or Firm*—Price, Heneveld, Huizenga & Cooper

[57] ABSTRACT

A mechanical engine protection system includes a temperature responsive valve, a pressure sensing valve and a mechanical shutdown actuator. The valves and actuator are fluidly interconnected so that the actuator is shifted from a run position to a shutdown position upon the occurrence of a high engine operating temperature condition or a low oil pressure condition. The temperature responsive valve includes an inlet port, an outlet port and a drain port. A valve element is positioned by a thermally responsive unit or motor to selectively interconnect the outlet port with either the inlet port or the drain port. The pressure sensing valve includes an inlet port, an outlet port, a drain port and a pilot port. A diaphragm motor positions a valve element in response to the pressure signal applied to the control port to selectively interconnect the outlet port with the inlet port or the drain port. The shutdown actuator includes an inlet port, an actuator rod and a spring loaded diaphragm motor.

64 Claims, 7 Drawing Figures

MECHANICAL ENGINE PROTECTION SYSTEM

BACKGROUND OF THE INVENTION

The present invention relates to systems for protecting an engine upon the occurence of a low oil pressure condition or a high engine temperature condition and, more particularly, to a unique mechanical system including an actuator, a pilot controlled pressure sensor and a temperature sensing valve.

Heretofore, various forms of engine shutdown systems have been proposed. Such systems are primarily adapted for protection of diesel engines in industrial vehicles, trucks and the like. These systems automatically shut down an engine whenever an abnormal operating condition is detected. Such conditions include a dangerously low or a total loss of engine oil pressure and/or a dangerously high engine or engine coolant temperature. In the event of a ruptured oil line or a broken fan belt and other cooling system failures, immediate action must be taken by the vehicle operator if damage to the engine is to be prevented. Failure to notice an abnormal operating condition and/or an intentional refusal to take corrective action are overcome through an automatic shutdown system.

An example of a prior shutdown or engine protection system may be found in commonly owned U.S. Pat. No. 3,602,207 entitled Automatic Override for Engine Safety Shutdown Systems and issued on Aug. 31, 1971 to Kilmer. This commonly owned patent discloses a system including a pressure sensor which senses engine oil pressure and an engine coolant temperature sensor. These sensors are electrical/mechanical devices which control a solenoid operated fuel valve, for example. Each sensor includes a normally closed switch and a normally open switch. Should engine oil pressure drop dangerously low or engine operating temperature rise above an acceptable maximum, the sensors close the engine fuel valve, thereby automatically shutting down the engine. Other systems including similar mechanical and electrical sensors actuate an air solenoid which in turn causes actuation of the shutdown lever on the engine governor box. The system disclosed in U.S. Pat. No. 3,602,207 also incorporates an electronic override circuit which permits engine start-up and also permits restart of the engine for a limited period after automatic shutdown.

Engine protection systems are also desirable for certain industrial applications wherein the engine to be protected does not have its own electrical power supply. Such applications include irrigation systems, mine vehicles and other industrial uses. The system as disclosed in U.S. Pat. No. 3,602,207 would not be usable in such applications.

Other forms of engine protection systems automatically control the flow of air through the coolant radiator in response to engine temperature. A temperature sensor and actuator controls a shutter arrangement mounted on the radiator. An example of such a system may be found in commonly owned U.S. Pat. No. 3,853,269 entitled Temperature Actuated Valve and issued on Dec. 10, 1974 to Graber. Shutter control systems typically use compressed air to actuate the shutters. Some systems use an electric motor for shutter position. Available systems are not useable on engines without compressed air such as found in medium or small delivery vehicles and fixed industrial installations.

SUMMARY OF THE INVENTION

A need exists for a completely mechanical engine protection system which will prevent or limit engine damage upon the occurrence of a high engine temperature and/or a low oil pressure condition. In accordance with the present invention, a system is provided which fulfills such need.

Essentially, the system includes a mechanical shutdown actuator including a shiftable member which is normally held in a run position by the oil pressure of the engine oil system. The shutdown actuator is fluidly connected to a pressure responsive or sensing valve and a temperature sensing valve. These valves remove or drain the actuating oil pressure from the shutdown actuator upon the occurrence of a low oil pressure condition or a high engine operating temperature condition.

In the preferred form, the temperature responsive valve includes an inlet connected to the engine oil supply system and an outlet at which a pilot pressure signal is generated. The valve further includes a drain, a valve element and a thermally responsive unit which positions the valve element within the body. During normal engine operating conditions, the inlet is connected to the outlet. Upon the occurrence of a high temperature condition, the valve element is shifted to close off the inlet and connect the outlet with the drain.

The pressure responsive or sensing valve is a pilot operated valve including a valve body defining an inlet port, an outlet port, a drain port and a control port. The outlet port of the temperature sensing valve is connected to the control port. The inlet port of the pressure sensing valve is connected to the engine oil supply system. An expansible chamber motor positioned by the pilot or control pressure signal selectively connects the output port with the input port or the drain port. Should the engine oil pressure drop, the outlet is connected to the drain port. Also, should engine temperature increase above a predetermined safe operating level, the output port of the temperature sensing valve is connected to the drain, thereby draining the oil from the control port. This connects the output port of the pressure sensing valve to its drain.

The output port of the pressure sensing valve is connected to the shutdown actuator. The shutdown actuator includes a body defining a chamber and within which a rolling diaphragm is disposed. The undersurface of the diaphragm is exposed to oil pressure. An acutator member or rod is positioned by the diaphragm. A knob is secured to the rod to permit manual positioning of the actuator for override and/or engine start. A spring normally biases the diaphragm and hence the actuator rod to a shutdown position. Application of engine oil under pressure to the undersurface of the diaphragm biases the diaphragm and the actuator to the engine run position. The actuator rod member positions the manual fuel control of the engine.

The mechanical system in accordance with the present invention is reliable in operation, relatively inexpensive to manufacture and is easily installed in a wide variety of applications. The system and individual components, in accordance with the present invention, provide an efficient and reliable means for automatically shutting down engine operation to prevent severe engine damage upon the occurrence of abnormal operating conditions.

DETAILED DESCRIPTION OF THE PREFERRED EMBODIMENT

Figure 1:
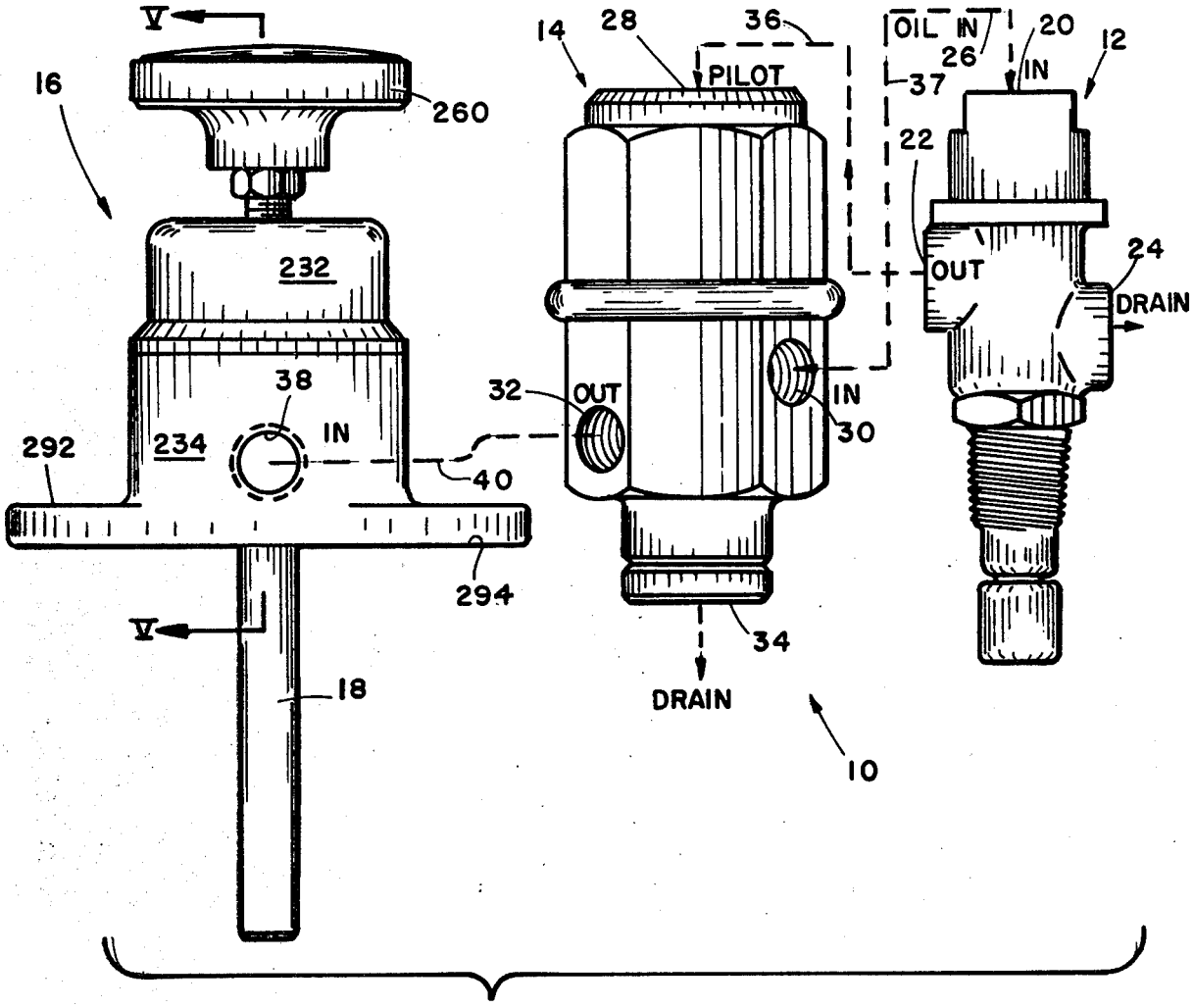
FIG. 1 is an elevational view of a mechanical engine protection system in accordance with the present invention.

The overall mechanical engine shutdown system in accordance with the present invention is illustrated in FIG. 1 and generally designated 10. System 10 includes a temperature sensing valve generally designated 12, a pressure sensing valve generally designated 14, and a mechanical actuator generally designated 16. Components 12, 14 and 16 are fluidly interconnected and operate off the engine lubricating or oil system. The oil system provides a source of hydraulic actuating fluid, as explained in more detail below.

Actuator 16, as seen in FIG. 1, includes an actuator member or rod 18. Rod 18, in use, contacts the manual shutdown or fuel control rack of the governor of an engine to be controlled.

Temperature sensing valve 12 defines an inlet port 20, an outlet port 22 and a drain port 24. Inlet port 20 is connected to the engine lubricating system by a line designated 26.

Pressure sensing valve 14 includes a control port 28, an inlet port 30, an outlet port 32 and a drain port 34. Control port 28 is connected to outlet port 22 of valve 12 by a line 36. Inlet port 30 of valve 14 is connected to the engine lubricating system by a line 37.

Mechanical shutdown actuator 16 includes an inlet port 38 which is fluidly connected to the outlet port of the valve 14 by a line 40. As explained below, engine oil under pressure entering port 38 holds actuator rod or member 18 in a run position. Upon the loss of actuating fluid pressure at port 38, rod 18 shifts to a shutdown position, cutting off fuel flow. The system is completely mechanical in nature and uses the lubricating oil system of the engine as its source of operating fluid.

TEMPERATURE SENSING VALVE

Figures 6, 7:
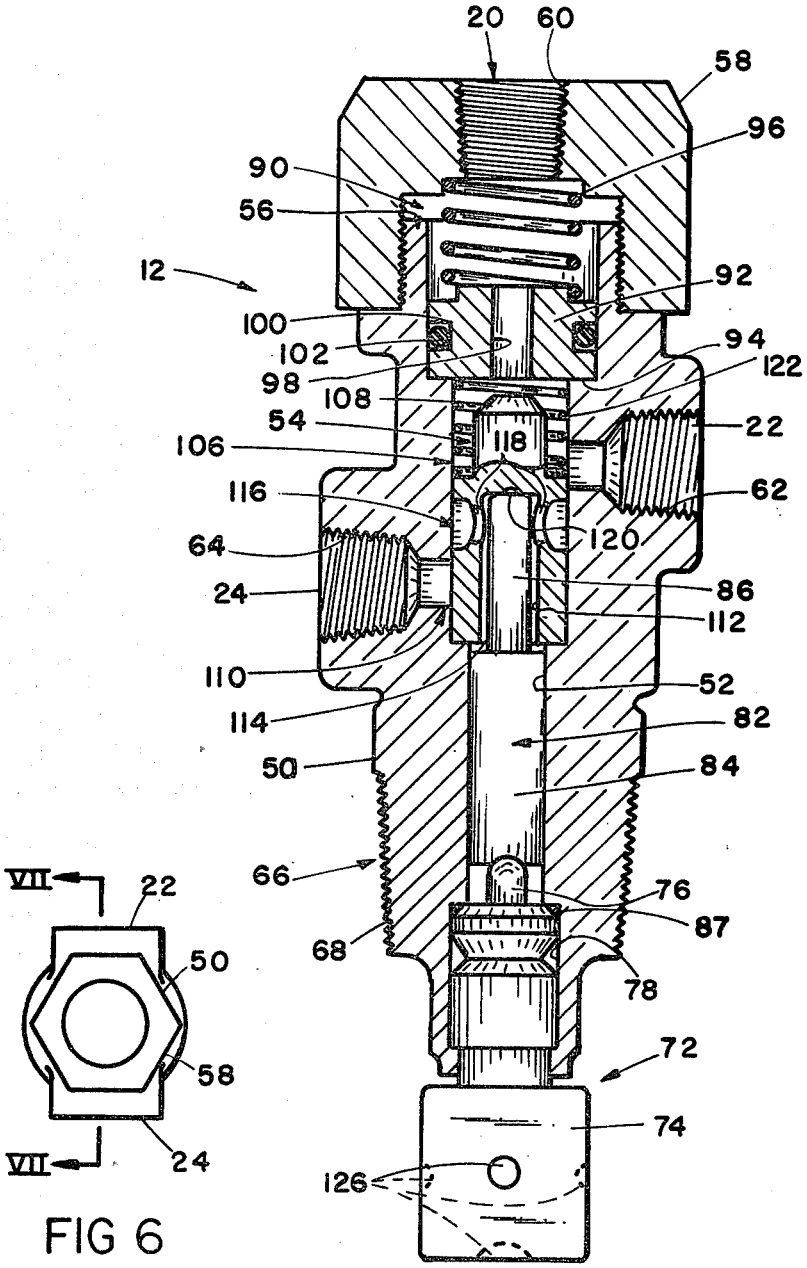
FIG. 6 is a top, plan view of a temperature sensing valve in accordance with the present invention.
FIG. 7 is a cross-sectional view taken generally along line VII—VII of FIG. 6.

Temperature sensing valve 12, in accordance with the present invention, is best seen in FIGS. 6 and 7. As shown therein, valve 12 includes a cast and/or machined body 50. Body 50 defines an elongated, axially extending bore 52. Bore 52 defines a valve chamber 54, and ports 22, 24 open into the valve chamber. An upper end 56 of body 50 is threaded and receives an end cap 58. End cap 58 defines inlet port 20. As seen in FIG. 7, ports 20, 22 and 24 include threaded, tapered bores 60, 62, 64, respectively. Hydraulic lines or hoses are threadably connected to the valve at these bores. A lower end 66 of body 50 is provided with external threads 68. Valve body 50 may, therefore, be threadably secured to a threaded opening in the engine coolant system.

Secured within bore 52 at the lower end 66 of valve 12 is a thermally responsive element or motor 72. Motor 72 includes a power element or portion 74 and a pin 76. Element 72 is a commercially available "wax motor". An expansible material is disposed within portion 74. As the material is heated by the engine coolant, it expands and pushes pin 76 outwardly. Body 50 is crimped or swaged to retain motor 72 within an enlarged portion 78 of bore 52. Output pin 76 is seated against an elongated steel rod 82. Rod 82 includes an enlarged, cylindrical portion 84 which slides within bore 52 and a reduced diameter, cylindrical portion 86. Portion 84 has a closely controlled fit to bore 52. An O-ring seal 87 (FIG. 7) seals bore 52 at motor 72.

End cap 58 and upper portion 56 of body 50 define an overtravel spring chamber 90. A valve seat 92 is movably positioned within chamber 90. Valve seat 92 is biased by a coil spring 96 against a shoulder 94 defined by body 50. Valve seat 92 is an annular or disc-shaped member defining a central through passage 98 and a circumferentially extending peripheral groove 100. An O-ring seal 102 is positioned within groove 100. Seal 102 engages the inner peripheral surface of bore 52. As should be readily apparent, fluid entering port 20 will pass into the chamber 90, through the passage 98 of valve seat 92, into valve chamber 54 and out port 22.

Supported on portion 86 of rod 82 is a valve element 106. Valve element 106 is a spool-like member including an upper valve portion 108 which is adapted to seat against valve seat 92 and close off passage 98. Element 106 further includes a spool portion 110. Portion 110 is axially elongated and defines a closed or blind bore 112 which opens through a lower end 114. Portion 110 also defines a circumferential groove 116. Groove 116 is placed in communication with the closed bore 112 by spool or transfer ports 118. Upper end 120 of rod portion 86 seats against the closed end of the bore 112. A coil spring 122 disposed within chamber 54 between seat 92 and valve element 106 biases the valve element and rod 82 away from valve seat 92. Spool portion 110 has a closely controlled fit to the inner peripheral surface of chamber 54. Due to precisely maintained tolerances, portion 110 creates a hydraulic seal with the inner peripheral surface of chamber 54.

In the normal operating condition below the predetermined maximum acceptable engine operating temperature, valve element 106 is positioned away from valve seat 92. As a result, inlet port 20 communicates with outlet port 22 through valve seat 92 and valve chamber 54. As the temperature of the engine coolant system increases, pin 76 extends, shifting valve element 106 towards seat 92 through rod 82. When portion 108 of valve element 106 contacts seat 92, fluid may no longer pass through port 20 into the valve chamber and to outlet port 22. Instead, the outlet port 22 is now placed in fluid communication with the drain port 24 through groove 116, transfer ports 188, blind bore 120 and valve chamber 54. Fluid communication is also established between port 24 and bore 120 through open end 114 of spool portion 110. As a result, fluid under pressure in line 36 (FIG. 1) may now drain back through the valve body and out port 24. If the temperature increases further, causing further travel of pin 76, seat 92 may shift within overtravel chamber 90 against the bias of spring 96. This overtravel feature prevents damage to the valve element and the wax motor 72. As the coolant temperature decreases below the acceptable maximum, springs 96 and 122 bias the valve element back to its first or operating condition and push pin 76 into motor 72.

In its presently preferred form, the temperature sensing valve 12 has a body 50 formed from brass and cap 58 machined from aluminum. Valva seat 92 is preferably formed from a glass-filled or fiberglass reinforced polytetrafluoroethylene (PTFE) material. Spool 106 is formed from cold rolled steel. A 20 percent glass-filled PTFE is suitable. Such possesses the required heat resistance characteristics and is sufficiently "soft" to achieve an essentially leak-free seal between valve element portion 108 and the seat.

Wax motor 72 is a commercially available item which may be accurately set to respond at a predetermined temperature. As seen in FIG. 7, motor portion 74 includes a plurality of dimples 126. Dimples 126 are formed during the temperature setting process. The set actuator 72, it is initially placed in a hot bath which is heated to the temperature setting desired. Pins are pressed against the sides of portion 74 compressing the thermally expansive material within portion 74. The pins deform the portion 74 to form dimples 126 and are pushed in until the motor actuates. The dimples reduce the volume inside of portion 74, thereby pushing actuator pin 76 outwardly at the desired temperature setting. Heretofore, the temperature setting of the wax motors in temperature responsive valves employed in engine protection systems was obtained by threading the motor to the body and positioning the motor in or out to change the temperature setting. Precise actuation temperatures were not obtainable. Also, this prior method of setting the actuation temperature would permit an incorrect setting or tampering in the field which could result in actuation at a temperature different than that desired. The present thermal unit 72 incorporated in valve 12 overcomes this problem.

PRESSURE RESPONSIVE OR SENSING VALVE

Figure 2:
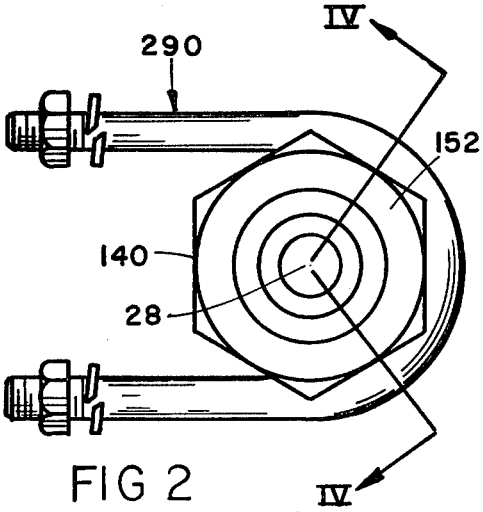
FIG. 2 is a top, plan view of a pressure sensing valve in accordance with the present invention.
Figure 3:
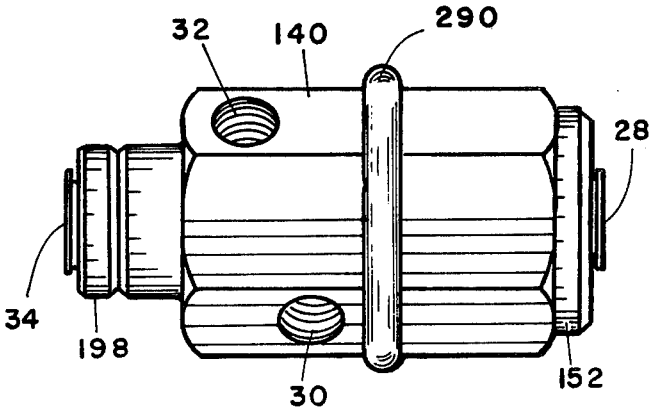
FIG. 3 is a side, elevational view of the pressure sensing valve.
Figure 4:
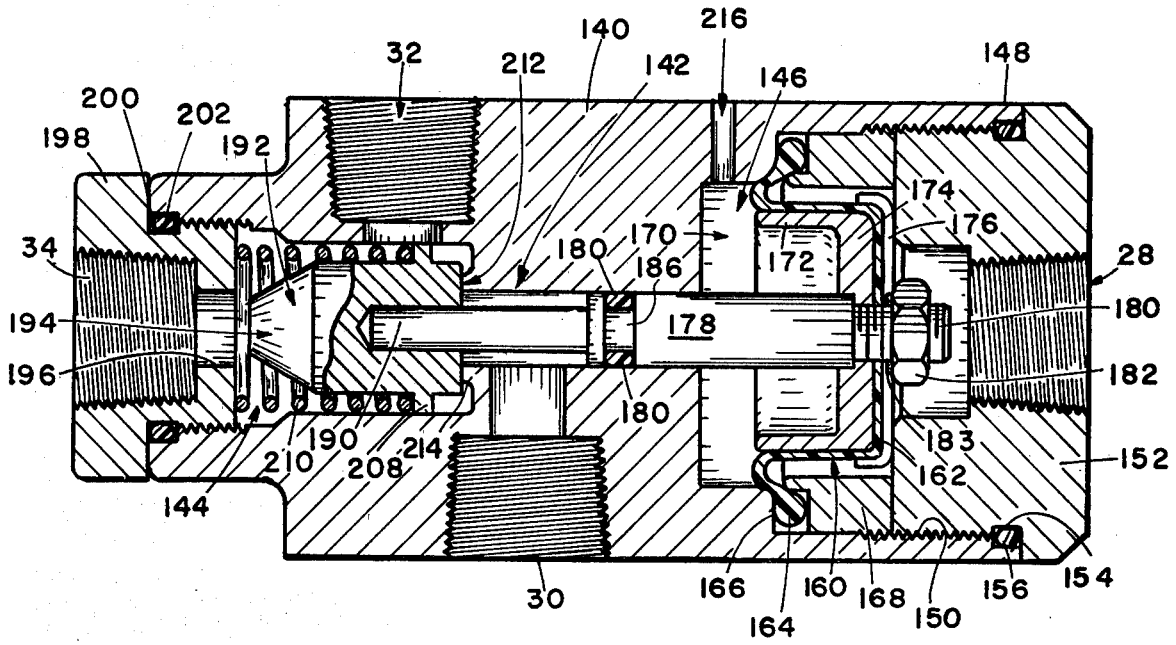
FIG. 4 is a cross-sectional view taken generally along line IV—IV of FIG. 2.

Pressure sensing valve 14 is best seen in FIGS. 2, 3 and 4. As shown therein, the valve includes a main body 140. Body 140 defines inlet port 30, outlet port 32 and an elongated, axially extending bore 142. Bore 142 is stepped in cross section and defines a valve chamber 144 and a diaphragm or expansible motor chamber 146. Upper end 148 of body 140 includes a threaded inner peripheral surface 150. Threadably secured to upper portion 148 is a cap 152. Cap 152 defines pilot or control port 28. Cap 152 further defines a peripheral groove 154 within an O-ring seal 156 is disposed.

Disposed within chamber 146 and secured to body 140 is an expansible chamber actuator including a diaphragm 160. Diaphragm 160 includes a central area 162 and a peripheral bead 164. Bead 164 is clamped against a shoulder 166 defined by body 140 by an annular slip ring 168 and cap 152. Slip ring 168 permits cap 152 to be threaded to body 140 to secure the diaphragm without damaging bead 164. A cup-shaped piston 170 including a skirt portion 172 and a flat crown portion 174 is secured to diaphragm 160 by a retainer plate 176. An undersurface of diaphragm 160 and chamber 146 is vented to atmosphere through a vent bore 216.

A stainless steel actuator rod 178 extends within bore 142. Rod 178 includes a threaded upper portion 180 which extends through piston 170, diaphragm portion 162 and retainer 176. A nut 182 clamps diaphragm portion 162 between piston 170 and retainer 176. A flat, nitrile seal 183 (FIG. 4) is positioned between nut 182 and retainer 176. Rod 178 further defines a circumferential groove 186 which receives an O-ring seal 180. Seal 180 engages the inner peripheral surface of bore 142.

A valve element or spool 192 is carried by a lower portion 190 of rod 178. Spool 192 is generally cylindrical in shape and includes a frusto-conical portion 194 which is adapted to engage a valve seat 196 defined by a lower end cap 198. Lower end cap 198 defines drain port 34. Cap 198 is threaded to the lower end of body 140 and defines a groove 200 which receives an O-ring seal 202. Valve element or spool 192 also defines a circumferential flange 208. Positioned between flange 208 and valve seat 196 is a coil spring 210. Coil spring 210 biases valve element 192 away from seat 196 and drain port 34.

As set forth above, inlet port 30 is connected by a suitable hydraulic line 37 to the engine lubricating system. Pilot port 28 is connected through line 36 to the outlet port 22 of the temperature responsive valve 12. Upon the application of fluid pressure to port 28, diaphragm actuator 160 shifts rod 178 to seat valve element 192 against valve seat 196. As a result, fluid will communicate through port 30 and valve chamber 144 to outlet port 32. Fluid pressure within the expansible chamber portion above diaphragm 160 holds valve element 192 seated against the force of spring 210. When the pressure applied to port 28 decreases below the force generated by spring 210, valve element 192 is shifted away from seat 190 until an upper portion 212 seats against an annular valve seat 214 defined by body 140. When in this position, which is illustrated in FIG. 4, inlet port 30 no longer communicates with valve chamber 144. Outlet port 32 is now in fluid communication with drain port 34 through valve seat 196. Fluid under pressure at port 32 is relieved or drained through port 34.

Valve 14 is, therefore, a pilot actuated or operated three-port valve. Pilot pressure at port 28 selectively interconnects the outlet port 32 with either inlet port 30 or drain port 34, depending upon the pilot pressure signal.

It is presently preferred that end caps 152, 198 and body 140 be fabricated from an aluminum material. Slip ring 168 is preferably fabricated from a glass-filled polyamide such as a heat stabilized, 30 percent fiberglass reinforced Nylon 6/6. Valve element 192, as with valve element 106 of valve 12, is machined from a glass-filled polytetrafluoroethylene (PTFE). Diaphragm 160 is a rolling type diaphragm. In operation, it rolls along skirt 172 and the inner peripheral surface of the diaphragm chamber 170. This reduces frictional loads and makes operation more precise. It is presently preferred that the diaphragm 162 be formed a fabric coated with a high temperature elastomer such as epichlorohydrin that is heat and oil resistant. The diaphragm should have an operating temperature range of −40° F. to 280° F., an pressure differential range across the diaphragm of 0 PSI to 175 PSI and a minimum expected life of 250,000 cycles. The elastomer may be a commercially available item sold under the trademark Hydrin 200, and the fabric may be that sold under the trademark Dacron.

SHUTDOWN ACTUATOR

Figure 5:
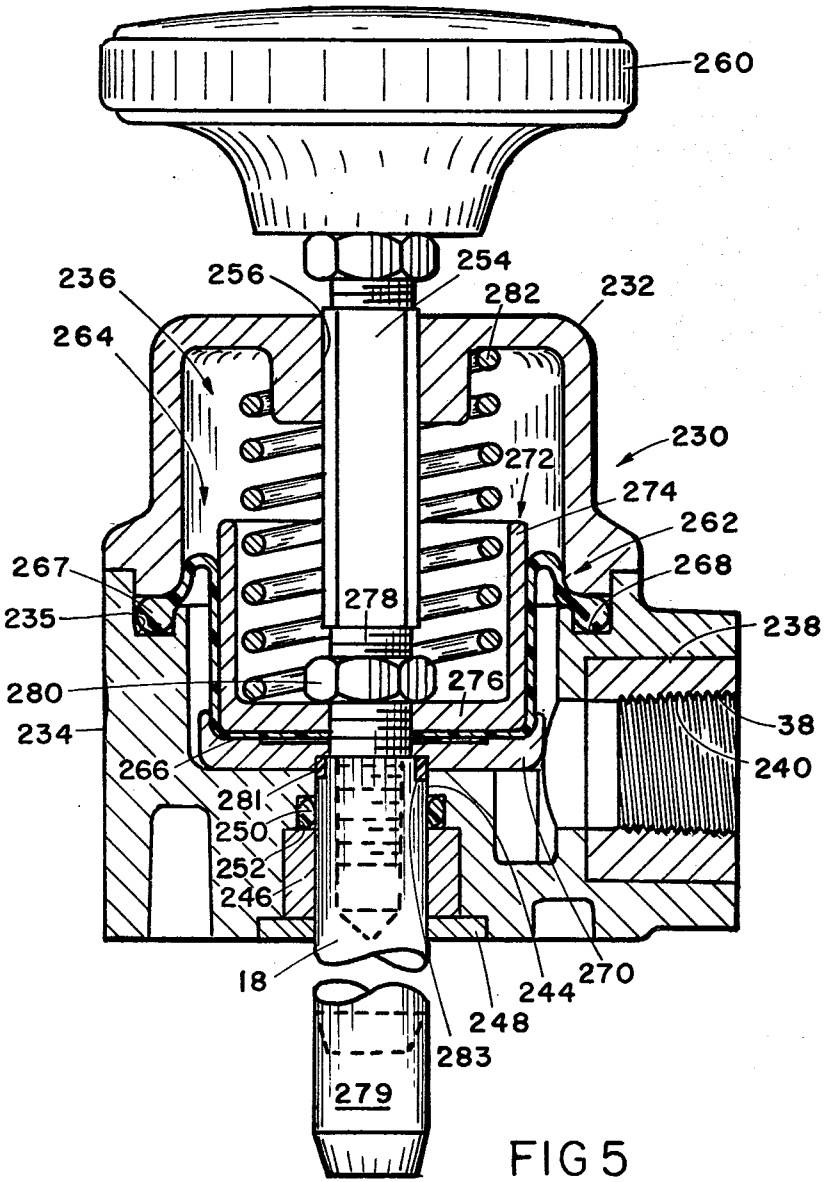
FIG. 5 is a cross-sectional view taken generally along line V—V of FIG. 1.

Shutdown actuator 16 is best seen in FIGS. 1 and 5. As shown therein, actuator 16 includes a body 230 defined by an upper cap portion 232 and a lower, main portion 234. Portions 232 and 234 define an expansible motor chamber 236. Body portion 234 defines inlet port 38. It is presently preferred that portions 232 and 234 be fabricated from an engineering thermoplastic. A rigid, knurled metal bushing or insert 238 having a threaded through bore 240 defining port 38 is mechanically secured to body portion 234 during the fabrication process. Body 234 is preferably molded around the insert. When manufactured from a thermoplastic material, portions 232 and 234 may be joined by an ultrasonic weld.

Body portion 234 defines a generally centrally located bore or opening 244. Extending through bore 244 issteel actuator rod 18. Rod 18 is in slidable engagement with a rigid metal, guide bushing 246 which is retained by an ultrasonically joined plastic washer 248. An O-ring seal 250 engages the outer peripheral surface of rod 18 and is disposed within a groove 252. Rod 18 includes an upper portion 254 which extends through chamber 236 and through a bore 256 formed in upper body portion or cap 232. Threadably secured to the upper end of rod 254 is a knob 260.

An expansible chamber motor 262 is disposed within chamber 236 to shift rod 18 between a shutdown position illustrated in solid lines in FIG. 5 and a run position illustrated in phantom. Motor 262 includes a rolling diaphragm 264. Diaphragm 264 includes a central portion 266 and a peripheral bead 267. Peripheral bead 267 is clamped between upper portion 232 of the body and a shoulder 268 defined by body portion 234. Portions 232 and 234 define a groove 235 within which bead 267 is retained. Diaphragm portion 266 is clamped between a circular retainer 270 and a piston 272. Piston 272 includes an axially extending skirt 274 and a crown 276. Rod 18 includes a reduced diameter threaded portion 278 which extends through crown 276, diaphragm portion 266 and retainer 270. Portion 278 is threaded into a separate rod portion 279 which extends out of the body (FIG. 5). Rod 18 is secured to the diaphragm and piston by a nut 280. A flat seal 281 is disposed between a shoulder 283 on rod portion 279 and retainer 270. A coil spring 282 is disposed within the portion of the chamber defined by cap 232. Spring 282 engages the inner surface of piston 272 and biases rod 18 to the shutdown position.

As should be readily apparent, fluid under pressure entering inlet port 38 will hold the diaphragm and actuator rod 18 against the bias of spring 282 to retain rod 18 in the run position. When pressure is relieved at port 38, rod 18 is shifted to the shutdown position under the bias of spring 282. The upper portion of the chamber 236 within which spring 282 is disposed is vented through the loose fit between rod portion 254 and bore 256. As explained below, knob 260 is grasped by the operator to permit engine start-up.

It is presently preferred that the body halves 232, 234 be injection molded from an engineering thermoplastic polyamide such as 30 percent glass-filled Nylon 6/6. Insert 238 is formed with a herringbone knurl on its outer peripheral surface. This insures a mechanical lock of the insert to body 234 which is molded around the insert. Piston 272, retainer 270 and washer 248 are also preferably fabricated from a glass-filled Nylon 6/6. It is presently preferred that the Nylon 6/6 material used in valve 14 and actuator 16 have the following characteristics:

| | |
|---|---|
| Melting Point (ASTM D789) | 255° C./265° C. |
| Specific Gravity | 1.34–1.38 g/cm$^3$ |

-continued

| | |
|---|---|
| (ASTM D792) | |
| Moisture Content (ASTM D789) | 0.2% Max. |
| Fiberglass Content, by Weight | 30–35% |
| Tensile Strength, Break - Minimum (ASTM D638, 23 ± 2° C.) | 1800 kg/cm$^2$ |
| Elongation at Break | 4% Min. |
| Impact Strength, Min. Izod, Notched at 23° C. (ASTM D256, ½ × ¼ in.) | 2.00 kg-cm/cm |
| Heat Deflection Temp. Min. (ASTM D648) | |
| At 66 PSI | 250° C. |
| At 264 PSI | 245° C. |
| Flexural Modulus, Min. (ASTM D790) | 91,400 kg/cm$^2$ |
| Water Absorption, Max. (ASTM D570, 24 hr.) | 1.0% |

OPERATION

In use, temperature responsive valve 12 is positioned so that the thermal unit 72 is within the engine cooling system. The pressure responsive valve 14 is secured to a suitable location at the engine by a U-bolt 290 (FIG. 2) or other such fastener. Shutdown actuator 16 is secured in a suitable location by fasteners passing through ears 292, 294 (FIG. 1) defined by body portion 234. The plumbing or hose connections are then made between the components. Inlet 20 is connected to the oil supply system, outlet 22 is connected to the control 28, inlet 30 is connected to the oil supply system and outlet 32 is connected to the inlet 38 of actuator 16. Suitable lines are connected to the drain ports 24, 34. When actuator 16 is correctly mounted, rod 18 will position a fuel control member (not shown) of the engine in the off position. For engine start-up, the operator grasps knob 260 and pulls it outwardly away from actuator body 232. This positions rod element 18 in the run position. After engine start-up and bringing of oil pressure up to an operating level, the rod 18 will be automatically held in the operating position.

As should be clear, the pressurized engine oil entering port 20 in the normal operating position passes through outlet port 22 to the control port 28 of valve 14. This pilot or control pressure signal at port 28 shifts diaphragm 170 so that the valve element 192 seats against the drain port seat 196. Oil under pressure from the lubricating system passes from the inlet port 30 of valve 14 to the outlet port 32. The oil passes through line 40 to the inlet port 38 of the shutdown actuator 16. The oil entering port 38 shifts the diaphragm actuator 262 against the bias of spring 282 to hold rod 18 in the run position.

Should the engine operating temperature exceed the maximum allowable limit, thermally responsive element 72 shifts valve element 54 to close off port 20. As a result, outlet port 22 is connected to drain port 24. The control pressure signal at port 28 drops as the oil drains back through line 36 and out drain port 24 of valve 12. This relief of pressure to the diaphragm actuator of valve 14 causes valve element 192 to shift against seat 214, thereby shutting off inlet port 320. The oil within the diaphragm chamber of the actuator 16 then drains back through line 40, port 32 and out drain port 34 of valve 14. Actuator member or rod 18 then shifts under the bias of spring 282 to the shutdown position.

In the event that the engine operating temperature is within acceptable limits but there is a loss of engine oil pressure, valve 12 will stay in its normally open position. The reduced system operating pressure is, however, transmitted to pressure sensing valve 14 through outlet port 22 and pilot or control port 28 of valve 14. When the pressure reaches the set point, the diaphragm actuator of valve 14 closes inlet port 30 and connects outlet port 32 to drain 34. As a result, the oil under pressure within the shutdown actuator 16 is relieved through drain port 34, and rod 18 shifts under the bias of spring 282 to the shutdown position. The system, therefore, provides reliable engine protection from both a low oil pressure condition and a high engine operating temperature condition.

The set point for actuation of pilot operated valve 14 is higher than the pressure which must be overcome by spring 282. For example, the pressure sensing valve assembly may actuate when the pressure at port 28 is reduced to 12±2 PSI. Spring 282 of shutdown actuator 16 will shift actuator rod 18when the pressure of port 38 is reduced 10±2 PSI. This "matching" of the operating characteristics of these two components insures that a complete shutdown is achieved when engine operating oil pressure is reduced to a minimum level without a total loss of system pressure. This also prevents the engine from being merely reduced to a low idle condition.

If both modes of protection are not desired, only one of the valve elements 12 or 14 need be provided. For example, if protection for high temperature conditions only is desired, valve element 14 is eliminated and outlet port 22 of valve 12 is plumbed directly to the inlet port 38 of shutdown actuator 16. When a high or critical temperature condition is experienced, actuator 16 will drain back through outlet port 22 and drain 24 resulting in a shutdown condition. If only oil pressure protection is desired, valve 12 is eliminated and the lubricating system is plumbed directly to the control port 28 and inlet port 30 of valve 14. upon sensing of a low oil pressure condition at port 28, shutdown actuator 16 will drain back through outlet port 32 and drain 34 of valve 14.

Further, an actuating fluid or source of fluid under pressure other than the lubricating system could be used in different applications. For example, valve 14 could be adapted to be air actuated. Control of air under pressure between ports 30, 32 and 34 could be accomplished with a minor modification in the valve element 192 to insure an effective seal of the compressed air. Further, temperature sensing valve 12 could be employed to control other engine protection systems besides a shutdown device. For example, in certain light vehicle or truck engine applications, the hydraulic or oil lubricating system could be used to control a radiator shutter through valve 12. Such shutters are typically mounted in front of the radiator to close off air flow through the radiator or regulate flow to maintain a relatively constant engine operating temperature. Such shutters would be biased to an open position by a spring loaded actuator. Hydraulic fluid or lubricating oil connected to inlet port 20 of valve 12 maintains the shutters in a closed position. Upon an increase of engine coolant temperature above a predetermined set point, the valve would close to drain outlet port 22 through drain port 24, thereby permitting the shutters to open.

Each of the components in accordance with the present invention is relatively easily and inexpensively manufactured when compared to prior shutdown control devices. The system is readily adaptable to many different engine applications. The system finds a prime use in industrial applications where electrical power is not available. The system provides for operator manual override for start-up and for restart after a shutdown. The mechanical components are reliable and can withstand the vibration of engine operation. The operating set points are readily predetermined by proper selection of the springs in the valves and by accurate settingof the thermally responsive motor 72. Only dimensional variations are necessary to adapt the system to the wide variety of existing engine designs.

In view of the foregoing description, those of ordinary skill in the art will undoubtedly envision various modifications to the invention which would not depart from the inventive concepts disclosed herein. For example, the configurations of the valves could be modified. Further, it is believed that expansible motor actuators other than the diaphragms illustrated could be used. It is, however, presently preferred that rolling diaphragms be employed due to their low frictional characteristics and high reliability. Therefore, it is expressly intended that the above description should be considered as only that of the preferred embodiment. The true spirit and scope of the present invention may be determined by reference to the appended claims.

The embodiments of the invention in which an exclusive property or privilege is claimed are defined as follows.

1. A mechanical engine protection system connectable to the lubricating system of an engine which serves as a source of fluid and operable in response to an increase in engine temperature above a predetermined level, said system comprising:

a temperature responsive valve means defining an inlet port adapted to be connected to said lubricating system, an outlet port, and a drain port, for generating a control pressure signal at said outlet port, which signal varies as a function of engine temperature, said valve means including a valve member having a valve portion, a closed bore and a transfer port for selectively interconnecting said outlet port with said inlet port of said drain port; and an expansible chamber means having an actuator port operatively connected to said outlet port for shifting an actuator member from a first position to a second position in response to said control pressure signal, said actuator member extending through said chamber means to permit manual actuation.

2. A mechanical engine protection system as defined by claim 1 wherein said temperature responsive valve means further comprises a valve body defining a valve chamber, said drain port, said inlet port and said outlet port, said ports opening into said valve chamber and said valve member being disposed within said valve chamber; and thermal actuator means operatively engaging said valve member for shifting said valve member from a first position at which fluid flows from said inlet port to said outlet port to a second position at which said inlet port is closed and said outlet port communicates with said drain port through said closed bore and said transfer port.

3. A mechanical engine protection system as defined by claim 2 wherein said temperature responsive valve means further comprises:

a valve seat within said bore between said valve member and said inlet port, said bore defining a shoulder; and a spring within said bore and engaging said valve seat for biasing said seat against said shoulder.

4. A mechanical engine protection system as defined by claim 3 wherein said valve member is generally cylindrical in shape and further defines a circumferential groove into which said transfer port opens.

5. A mechanical engine protection system as defined by claim 4 wherein said temperature responsive valve means further includes another spring between said seat and said valve member for biasing said valve member away from said seat.

6. A mechanical engine protection system as defined by claim 5 wherein said actuator means of said temperature responsive valve means comprises:

a wax motor having an output pin operatively engaging said valve member.

7. A mechanical engine protection system as defined by claim 6 further including:

a fluid pressure sensing valve means having an inlet connection to said fluid source, an outlet directly connected to said actuator port and a pilot port directly connected to said outlet port of said temperature responsive valve means, for causing said actuator member to shift to said second position in response to the fluid pressure level at said pilot port.

8. A mechanical engine protection system as defined by claim 7 wherein said fluid pressure sensing means comprises:

a body defining a valve chamber and a diaphragm chamber, said inlet and outlet ports opening into said valve chamber and said pilot port opening into said diaphragm chamber, said body further defining a drain port opening into said valve chamber;

a valve member movable within said valve chamber between first and second positions, said outlet port communicating with said drain port when said valve member is in its first position and said outlet port communicating with said inlet port when said valve member is in its second position;

a diaphragm disposed within said diaphragm chamber and having a surface facing said pilot port; and a rod having an end connected to said diaphragm and another end connected to said valve member.

9. A mechanical engine protection system as defined by claim 8 wherein said fluid pressure sensing means further includes:

a spring within one of said chambers for biasing said valve member to its first position.

10. A mechanical engine protection system as defined by claim 9 wherein said expansible chamber means comprises:

a body defining said actuator port and an actuator chamber, a rolling diaphragm disposed within said actuator chamber, said diaphragm having a surface exposed to said actuator port and said actuator member extending through said body and being connected to said diaphragm.

11. A mechanical engine protection system as defined by claim 10 wherein said expansible chamber means further includes:

a spring within said actuator chamber and engaging said diaphragm for biasing said actuator member to said second position.

12. A mechanical engine protection system connectable to a source of fluid under pressure for shutting down engine operation in response to a control pressure signal, said system comprising:

an actuator member;

an expansible chamber means having an actuator port and being connected to said actuator member for shifting said actuator member between first and second positions; and a pilot actuated valve means having a control port at which said control pressure signal is applied, an inlet port adapted to be connected to a source of fluid under pressure, drain port and an outlet port connected to said actuator port, for applying said source of fluid to said actuator port when said pressure signal is above a predetermined level and for draining said actuator port through said drain port when said pressure signal is below said predetermined level to cause said expansible chamber means to shift said actuator member between said first and second positions.

13. A mechanical engine protection system as defined by claim 12 wherein said source of fluid is the engine oil system.

14. A mechanical engine protection system as defined by claim 12 wherein said pilot actuated valve means comprises a valve body defining said inlet, drain and outlet ports, and a valve chamber.

15. A mechanical engine protection system as defined by claim 14 wherein said pilot actuated valve means further includes:

a valve member movable within said valve chamber for selectively permitting flow between said outlet port and said inlet port or between said outlet port and said drain port; and fluid actuator means on said body and exposed to said control pressure signal said control port for moving said valve member.

16. A mechanical engine protection system as defined by claim 15 wherein said fluid actuator means of said pilot actuated valve means includes a rolling diaphragm secured to said body within a control chamber, said valve member being connected to said diaphragm.

17. A mechanical engine protection system as defined by claim 16 wherein said expansible chamber means comprises:

a body defining a diaphragm chamber and said actuator port;

a rolling diaphragm secured within said diaphragm chamber and having a surface exposed to said actuator port;

a piston having a crown and a skirt, said diaphragm being secured to said crown; and a spring within said chamber engaging said piston for biasing said piston towards said actuator port, said actuator member extending through said body and being secured to said piston.

18. A mechanical engine protection system as defined by claim 16 further including:

temperature sensing means operatively connected to said pilot actuated valve means for generating said fluid control pressure signal as a function of engine temperature.

19. A mechanical engine protection system as defined by claim 17 further including:

temperature sensing means operatively connected to said pilot actuated valve means for generating said fluid control pressure signal as a function of engine temperature.

20. A mechanical engine protection system as defined by claim 19 wherein said temperature sensing means comprises:

a valve body defining a valve chamber, an inlet port, an outlet port and a drain port opening into said valve chamber; and valve means within said chamber for placing said inlet port in communication with said outlet port when engine temperature is below a predetermined level to generate said control pressure signal and closing said inlet port and placing said outlet port in communication with said drain port when engine temperature is above said predetermined level.

21. A mechanical engine protection system as defined by claim 20 wherein said valve means of said temperature sensing means includes:

a valve member movable within said valve chamber; and a thermally responsive motor having an output member contacting said valve member and which moves in response to engine temperature.

22. A mechanical engine shutdown system for causing engine shutdown in response to a low oil pressure condition in the oil supply or a high engine temperature condition, the system comprising:

a temperature sensing valve means having an inlet port operatively connected to the oil supply for normally directing oil under pressure to an outlet port and for permitting oil to flow from the outlet port to a drain port upon sensing of a high engine temperature condition;

a pressure sensing valve means, having a control port connected to the temperature sensing valve means outlet port, an inlet port connected to the engine oil supply, an outlet port and a drain port, for normally directing oil from said inlet port to said outlet port and permitting oil to flow from said outlet port to said drain port upon a drop of oil pressure at said control port to said low oil pressure condition; and an actuator means having an inlet port connected to said outlet port of said pressure sensing valve means and a shiftable actuator member adapted to shut down the engine and shiftable between a normal run position and a shutdown position for shutting down the engine upon the occurrence of the low oil pressure condition or the high engine temperature condition.

23. A mechanical engine shutdown system as defined by claim 22 wherein said temperature sensing valve means comprises:

a valve body defining the inlet port, the outlet port, the drain port and an elongated bore communicating with said ports;

a thermally responsive means secured to said body and having a pin extending into said bore for moving the pin in response to temperature changes;

a valve seat positioned between said inlet port and said elongated bore; and a valve element shiftable within said bore in response to movement of said pin, said valve element permitting flow from said inlet port to said outlet port when in a first position and when seated against said valve seat permitting flow between said drain port and said outlet port.

24. A mechanical engine shutdown system as defined by claim 23 wherein said body of said temperature sensing valve means defines an overtravel chamber between said valve seat and said inlet port, said valve seat being slidable within said overtravel chamber, said temperature sensing valve means further including an overtravel spring engaging said seat within said chamber whereby said seat may shift against the bias of said spring to accommodate overtravel movement of said valve element after it engages said valve seat.

25. A mechanical engine shutdown system as defined by claim 24 wherein said valve element of said temperature sensing valve means comprises an elongated body having a valve end facing said valve seat and an open end defining a fluid chamber, said body defining a spool port opening into said fluid chamber, said drain port being placed into communication with said outlet port when said valve end is seated on said valve seat through said fluid chamber and said spool port.

26. A mechanical engine shutdown system as defined by claim 25 wherein said temperature sensing valve means further includes an elongated rod extending from said pin to said valve element.

27. A mechanical engine shutdown system as defined by claim 26 wherein said valve element of said temperature sensing valve means defines a shoulder and said temperature sensing valve means further includes a return spring positioned between said shoulder and said valve seat for biasing said valve element away from said valve seat.

28. A mechanical engine shutdown system as defined by claim 27 wherein said temperature responsive element of said temperature sensing valve means is a wax motor.

29. A mechanical engine shutdown system as defined by claim 22 wherein said pressure sensing valve means comprises:

a valve body defining a valve chamber, said inlet port, said outlet port and said drain port opening into said valve chamber;

a first valve seat between said inlet and outlet ports;

a second valve seat at said drain port;

a valve element shiftable between a first position at said first valve seat preventing flow between said inlet and outlet ports and permitting flow between said outlet port and said drain port and a second position at said second valve seat closing off said drain port and permitting flow between said inlet and outlet ports; and valve element actuator means supported by said body for shifting said valve element between said positions as a function of the oil pressure at said control port.

30. A mechanical engine shutdown system as defined by claim 29 wherein said valve element actuator means of said pressure ssensing valve means comprises:

said body defining a piston chamber, said control port opening into said piston chamber;

a piston movable within said piston chamber; and a piston rod extending between said valve element and said piston.

31. A mechanical engine shutdown system as defined by claim 30 wherein said valve element actuator means of said pressure sensing valve means further includes:

a rolling diaphragm having a periphery secured to said body and a central area secured to said piston.

32. A mechanical engine shutdown system as defined by claim 31 wherein said pressure sensing valve means further includes:

an end cap threaded to said body and defining said control port which opens into said piston chamber; and a slip ring disposed between said end cap and said diaphragm periphery to thereby secure said diaphragm to said body.

33. A mechanical engine shutdown system as defined by claim 32 wherein said pressure sensing valve means further includes:

a spring engaging said valve element and said second seat for biasing said valve element towards said first seat.

34. A mechanical engine shutdown system as defined by claim 33 wherein said rolling diaphragm of said pressure sensing valve means is formed from an epichlorohydrin material.

35. A mechanical engine shutdown system as defined by claim 34 wherein said body of said pressure sensing valve means defines a vent port communicating with said piston chamber.

36. A mechanical engine shutdown system as defined by claim 22 wherein said actuator means further comprises:

a body defining said inlet port and an actuator chamber, said actuator member extending through said body and said chamber.

37. A mechanical engine shutdown system as defined by claim 36 wherein said actuator means further comprises:

a diaphragm disposed within said actuator chamber and having a surface in communication with said inlet port, said actuator being secured to said diaphragm; and a spring within said chamber for biasing said diaphragm to position said actuator member in said shutdown position.

38. A mechanical engine shutdown system as defined by claim 37 wherein said actuator means further comprises:

a piston clamped to said diaphragm, said piston being directly engaged by said spring and having said actuator secured thereto.

39. A mechanical engine shutdown system as defined by claim 38 wherein said body of said actuator means is formed in two parts from a thermoplastic, polyamide material with the parts being ultrasonically welded together.

40. A mechanical engine shutdown system as defined by claim 28 wherein said pressure sensing valve means comprises:

a valve body defining a valve chamber, said inlet port, said outlet port and said drain port opening into said valve chamber;

a first valve seat between said inlet and outlet ports;

a second valve seat at said drain port;

a valve element shiftable between a first position at said first valve seat preventing flow between said inlet and outlet ports and permitting flow between said outlet port and said drain port and a second position at said second valve seat closing off said drain port and permitting flow between said inlet and outlet ports; and valve element actuator means supported by said body for shifting said valve element between said positions as a function of the oil at said control port.

41. A mechanical engine shutdown system as defined by claim 40 wherein said valve element actuator means of said pressure sensing valve means comprises:

said body defining a piston chamber, said control port opening into said piston chamber;

a piston movable within said piston chamber; and a piston rod extending between said valve element and said piston.

42. A mechanical engine shutdown system as defined by claim 41 wherein said valve element actuator means of said pressure sensing valve means further includes:

a rolling diaphragm having a periphery secured to said body and a central rea secured to said piston.

43. A mechanical engine shutdown system as defined by claim 42 wherein said valve element actuator means of said pressure sensing valve means further includes:

a rolling dipahragm having a periphery secured to said body and a control area secured to said piston.

44. A Mechanical engine shutdown system as defined by claim 43 wherein said pressure sensing valve means further includes:

a spring engaging said valve element and said second seat for biasing said valve element towards said first seat.

45. A mechanical engine shutdown system as defined by claim 44 wherein said rolling diaphragm of said pressure sensing valve means is formed from a fluorsilicone material.

46. A mechanical engine shutdown system as defined by claim 45 wherein said body of said pressure sensing valve means defines a vent port communicating with said piston chamber.

47. A mechanical engine shutdown system as defined by claim 46 wherein said actuator means further comprises:

a body defining said inlet port and an actuator chamber, said actuator member extending through said body and said chamber.

48. A mechanical engine shutdown system as defined by claim 47 wherein said actuator means further comprises:

a diaphragm disposed within said actuator chamber and having a surface in communication with said inlet port, said actuator being secured to said diaphragm; and a spring within said chamber for biasing said diaphragm to position said actuator member in said shutdown position.

49. A mechanical engine shutdown system as defined by claim 48 wherein said actuator means further comprises:

a piston clamped to said diaphragm, said piston being directly engaged by said spring and having said actuator secured thereto.

50. A mechanical engine shutdown system as defined by claim 49 wherein said body of said actuator means is formed in two parts from a thermoplastic, polyamide material with the parts being ultrasonically welded together.

51. A mechanical engine shutdown system adapted to shut off the fuel flow to an internal combustion engine responsive to the oil pressure of the engine oil system or engine coolant temperature, said system comprising:

shutdown means including an actuator shiftable between a run position and a shutdown position for controlling fuel flow;

a coolant temperature responsive means for generating a pilot pressure signal in response to coolant temperature; and a pressure responsive means operatively connected to said coolant temperature responsive means and said shutdown means for shifting said actuator to said shutdown position in response to a decrease in the pilot pressure signal below a predetermined set point or in response to a decrease in oil pressure below a predetermined set point.

52. A mechanical engine shutdown system as defined by claim 51 wherein said shutdown means further comprises:

an expansible motor means connected to said actuator for shifting said actuator between said positions in response to a pressure signal generated by said pressure responsive means.

53. A mechanical engine shutdown system as defined by claim 52 wherein said pressure responsive means comprises a pilot operated valve having an inlet port connected to the engine oil system, an outlet port connected to said expansible motor means and a drain port, said pressure responsive means further including a valve operatively connected to said expansible motor means for selectively permitting flow between said inlet and outlet ports and said outlet and drain ports in response to said pilot pressure signal.

54. A mechanical engine shutdown system as defined by claim 53 wherein said expansible motor means comprises a diaphragm having a surface exposed to said pilot pressure signal.

55. A mechanical engine shutdown system as defined by claim 52 wherein said coolant temperature responsive means comprises:

a temperature responsive valve including an inlet connected to the engine oil system, an outlet port connected to said pressure responsive means and a drain, said valve further including a valve element shiftable between a first position permitting flow of engine oil between said inlet and outlet to generate said pilot pressure signal and a second position closing said inlet and opening said outlet to said drain.

56. A mechanical engine shutdown system as defined by claim 55 wherein said temperature responsive valve further includes:

a thermally responsive motor connected to said valve element for shifting said valve element between said positions in response to the engine coolant temperature.

57. A mechanical, manual override actuator for use in an engine protection system and adapted to be connected to a source of fluid, said actuator comprising:

a body defining a chamber and a bore opening into said chamber, said body being formed from a thermoplastic material in two joined parts;

a piston disposed within said chamber and including a skirt and a crown;

a rolling diaphragm having a central portion secured to said crown and a peripheral bead, said body defining a groove within which the bead is retained;

spring means within said chamber and engaging said piston for biasing a surface of said piston to a first position;

an actuator member extending through said body, said actuator member being joined to said piston and said diaphragm; and a rigid insert mechanically joined to said body at said bore and defining an actuator inlet port connectable to said source of fluid, said port opening into said chamber opposite said surface of said piston so that fluid under pressure entering said inlet port moves said piston and said actuator member from said first positon to a second position against the bias of said spring means.

58. A mechanical, manual override actuator as defined by claim 57 wherein said actuator member is an elongated rod extending through said body, said actuator further including a knob joined to said rod so that an operator may grasp said knob and shift said rod from said first to said second position against the bias of said spring means.

59. A mechanical, manual override actuator as defined by claim 58 wherein said body defines another bore in axial alignment with said rod and said actuator includes a rigid guide bushing in slidable engagement with said rod.

60. A mechanical, manual override actuator as defined by claim 59 wherein said rigid insert includes a knurled, herring bone outer surface to insure a mechanical lock of the insert to the body.

61. A mechanical, manual override actuator as defined by claim 60 wherein said body is formed from a thermoplastic, polyamide material.

62. A mechanical, manual override actuator as defined by claim 61 wherein said rolling diaphragm is formed from a fluorosilicone material which is heat and oil resistant.

63. A mechanical, manual override actuator as defined by claim 62 wherein said spring means is a coil spring.

64. A mechanical, manual override actuator as defined by claim 63 wherein said parts of said body are ultrasonically welded.

* * * * *

UNITED STATES PATENT AND TRADEMARK OFFICE

CERTIFICATE OF CORRECTION

PATENT NO. : 4,483,287

DATED : November 20, 1984

INVENTOR(S) : Larry E. Monigold, Ordale Lewis

It is certified that error appears in the above-identified patent and that said Letters Patent is hereby corrected as shown below:

Column 5, line 5:
"Valva" should be --Valve--;

Column 5, line 17:
"The" should be --To--;

Column 5, line 49:
After "within" insert --which--;

Column 6, line 52:
After "formed" insert --from--;

Column 6, line 55:
"an" should be --a--;

Column 7, line 11:
"issteel" should be --is steel--;

Column 8, line 33:
After "control" insert --port--;

Column 8, line 66:
"320" should be --30--;

Column 9, line 23:
"18when" should be --18 when--;

Column 10, line 12:
"settingof" should be --setting of--;

Column 10, line 47:
"of" should be --or--;

UNITED STATES PATENT AND TRADEMARK OFFICE

CERTIFICATE OF CORRECTION

PATENT NO. : 4,483,287

DATED : November 20, 1984

INVENTOR(S) : Larry E. Monigold, Ordale Lewis

It is certified that error appears in the above-identified patent and that said Letters Patent is hereby corrected as shown below:

Column 11, line 26:
"connection" should be --connected--;

Column 12, line 16:
Before "drain" insert --a--;

Column 14, line 58:
"ssensing" should be --sensing--;

Column 15, line 68:
After "oil" insert --pressure--;

Column 16, line 13:
"rea" should be --area--;

Column 16, line 20:
"Mechanical" should be --mechanical--.

Signed and Sealed this

*Twenty-eighth* Day of *January 1986*

[SEAL]

*Attest:*

DONALD J. QUIGG

*Attesting Officer* *Commissioner of Patents and Trademarks*